US009331395B2

(12) United States Patent
Kishino et al.

(10) Patent No.: US 9,331,395 B2
(45) Date of Patent: May 3, 2016

(54) ANTENNA PROVIDED WITH FALL-OUT PREVENTING ARRANGEMENT

(75) Inventors: Yuuki Kishino, Minato-Ku (JP); Tsunehisa Marumoto, Minato-Ku (JP)

(73) Assignee: NEC Corporation, Tokyo (JP)

( * ) Notice: Subject to any disclaimer, the term of this patent is extended or adjusted under 35 U.S.C. 154(b) by 490 days.

(21) Appl. No.: 13/820,402

(22) PCT Filed: Apr. 20, 2011

(86) PCT No.: PCT/JP2011/060200

§ 371 (c)(1), (2), (4) Date: Mar. 1, 2013

(87) PCT Pub. No.: WO2012/042958

PCT Pub. Date: Apr. 5, 2012

(65) Prior Publication Data

US 2013/0162492 A1 Jun. 27, 2013

(30) Foreign Application Priority Data

Sep. 29, 2010 (JP) ..... 2010-218219

(51) Int. Cl.

| | |
|---|---|
| ***H01Q 13/00*** | (2006.01) |
| ***H01Q 19/10*** | (2006.01) |
| ***H01Q 19/13*** | (2006.01) |
| ***H01Q 19/18*** | (2006.01) |
| ***H01Q 19/19*** | (2006.01) |
| ***H01Q 13/06*** | (2006.01) |

(52) U.S. Cl.

CPC ..... *H01Q 19/104* (2013.01); *H01Q 13/06* (2013.01); *H01Q 19/134* (2013.01); *H01Q 19/18* (2013.01); *H01Q 19/193* (2013.01)

(58) Field of Classification Search

CPC ..... H01Q 19/19

See application file for complete search history.

(56) References Cited

U.S. PATENT DOCUMENTS

2006/0044207 A1* 3/2006 Dolson ..... 343/878

FOREIGN PATENT DOCUMENTS

| | | | |
|---|---|---|---|
| CN | 1271470 | A | 10/2000 |
| CN | 101214103 | A | 7/2008 |
| CN | 101383451 | A | 3/2009 |
| CN | 101536885 | A | 9/2009 |
| CN | 101841082 | A | 9/2010 |
| JP | 56-122508 | A | 9/1981 |
| JP | H01212103 | A | 8/1989 |
| JP | H04247703 | A | 9/1992 |
| JP | 6-204737 | A | 7/1994 |
| JP | 9-199937 | A | 7/1997 |

(Continued)

OTHER PUBLICATIONS

Office Action dated Mar. 27, 2014 in related Chinese Application No. 201180044035 with partial English-language translation (15 pgs.).

(Continued)

*Primary Examiner* — Graham Smith

(74) *Attorney, Agent, or Firm* — Foley & Lardner LLP

(57) ABSTRACT

Provided is an antenna, including: a dielectric support portion mounted to a tip of a waveguide; and a reflector bonded and fixed to the dielectric support portion. The dielectric support portion includes: an accommodating portion accommodating the reflector therein; and a fall-off preventing arrangement preventing the reflector from falling off under a state in which the reflector is accommodated in the accommodating portion.

7 Claims, 8 Drawing Sheets

(56) References Cited

FOREIGN PATENT DOCUMENTS

| | | | |
|---|---|---|---|
| JP | 2000-228609 | A | 8/2000 |
| JP | 2009-17346 | A | 1/2009 |
| WO | WO 2006/129365 | A1 | 12/2006 |
| WO | WO 2010/134647 | A1 | 11/2010 |

OTHER PUBLICATIONS

Office Action mailed Jan. 7, 2015 in related Japanese Application No. 2010-218219 with partial English-language translation (5 pgs.).

* cited by examiner

ANTENNA PROVIDED WITH FALL-OUT PREVENTING ARRANGEMENT

This application is the National Phase of PCT/2011/060200, filed Apr. 20, 2011, which claims priority to Japanese Application No. 2010-218219, filed Sep. 29, 2010, the disclosures of which are hereby incorporated by reference in their entirety.

TECHNICAL FIELD

This invention elates to structure of a sub-reflecting mirror of a reflector antenna including the sub-reflecting mirror, and more particularly, to a fixing technology for retaining the sub-reflecting mirror in a stable state at a predetermined position for a long period of time.

BACKGROUND ART

In recent years, along with widespread use of mobile phones, mobile phone base stations are being installed in places all over the world. For connection of a mobile phone network, it is necessary to construct a network for connecting the mobile phone base stations to each other. When a wired network is used as the network for connecting the mobile phone base stations to each other, enormous construction cost is required, and hence a wireless network is often used globally. In this wireless network, one-to-one communication is normally established, and hence a reflector antenna capable of achieving a high gain in one direction is used.

As a conventional reflector antenna, Japanese Unexamined Patent Application Publication (JP-A) No. 2009-17346 (hereinafter referred to as "Patent Literature 1") discloses the following reflector antenna 160. Specifically, as illustrated in FIG. 16, electromagnetic waves from a primary radiator 161 reflect off a sub-reflecting mirror 162 to enter a main reflecting mirror 163. The reflector antenna 160 of this type includes the plurality of reflecting mirrors 162, 163, and hence is called a dual reflector antenna. The sub-reflecting mirror 162 is closely supported on a dielectric support member 164 mounted to a tip of the primary radiator 161.

SUMMARY OF INVENTION

Technical Problem

In the dual reflector antenna 160 described in Patent Literature 1, the sub-reflecting mirror 162 is closely supported on the dielectric support member 164 mounted to the tip of the primary radiator 161. Here, as a method of closely supporting the sub-reflecting mirror 162 on the dielectric support member 164, bonding with an adhesive is generally employed. This is because electromagnetic waves pass through a jointing part between the dielectric support member 164 and the sub-reflecting mirror 162, and hence a metal fastening member such as a screw cannot be used in the jointing part.

However, a bonding strength exerted by the adhesive significantly depends on various bonding conditions such as a cleaned state of a surface to he bonded, an application amount of the adhesive, and a dried state of the adhesive at the time of bonding work. Accordingly, at the time of bonding work, it is necessary to appropriately control a large number of matters, and satisfactory bonding conditions cannot be always realized because of irregularities of work and the like.

In addition, the antenna of this type is exposed to wind and rain, and is used in an outdoor environment in which a temperature and humidity constantly change. Thus, it is unclear whether or not a predetermined jointing strength can be kept for a long period of time by bonding with the adhesive, and there is a problem of having no idea when the sub-reflecting mirror 162, which is bonded to the dielectric support member 164 with the adhesive, falls off.

Therefore, it is an object of this invention to prevent falling off of the sub-reflecting mirror bonded to the dielectric support member with the adhesive, and to increase reliability of the dual reflector antenna.

Solution to Problem

According to an exemplary embodiment of this invention, there is provided an antenna, characterized by including; a dielectric support portion mounted to a tip of a waveguide; and a reflector bonded and fixed to the dielectric support portion, the dielectric support portion including: an accommodating portion for accommodating the reflector therein; and a fall-off preventing arrangement for preventing the reflector from falling off under a state in which the reflector is accommodated in the accommodating portion.

Advantageous Effect of Invention

According to this invention, load on the adhesive is reduced, and thus the adhesive is prevented from peeling off. Even when the adhesive peels off, the reflector can be prevented from falling off.

MODE FOR EMBODYING THE INVENTION

Figure 1:
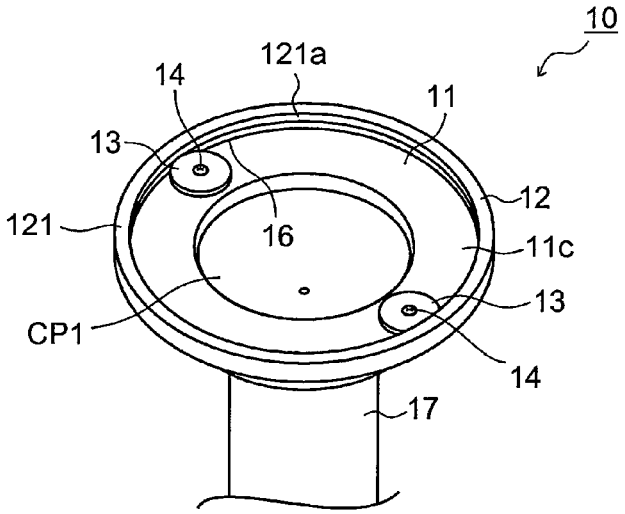
FIG. 1 is a perspective view of a feed section for use in an antenna according to a first exemplary embodiment of this invention.

In the following, an antenna according to each exemplary embodiment of this invention is described in detail with reference to the drawings. In the following description, for the sake of convenience, regarding components, members, and the like illustrated in each drawing, a part illustrated in an upper part of the drawing is referred to as an upper side or an upper portion, and a part illustrated in a lower part of the drawing is referred to as a lower side or a lower portion. However, when using the antenna, the part referred to as the upper side or the upper portion is not always situated above the part referred to as the lower side or the lower portion.

Figures 2A, 2B:
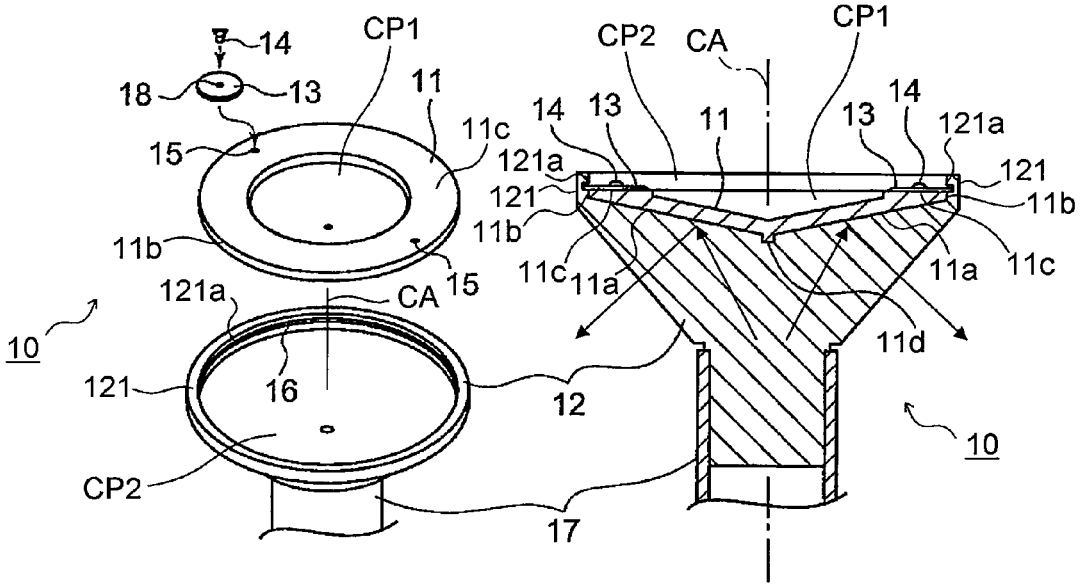
FIGS. 2A and 2B are an exploded perspective view and a longitudinal sectional view of the feed section illustrated in FIG. 1, respectively.

FIG. 1 is a perspective view illustrating a configuration of a feed section 10 for use in an antenna according to a first exemplary embodiment of this invention. Further, FIGS. 2A and 2B are an exploded perspective view and a longitudinal sectional view illustrating details of the feed section 10, respectively. Note that, an entire configuration of the antenna is the same as that of a conventional antenna (see FIG. 16).

The illustrated feed section 10 includes a reflector (sub-reflecting mirror) 11, a dielectric support portion 12 supporting the reflector 11, a pair of fasteners (plate members) 13 for fastening the reflector 11, and a pair of screws 14 for fixing the pair of fasteners 13 onto the reflector 11.

The reflector 11 has substantially a low-height conical shape having an apex on a lower side thereof. Specifically, the reflector 11 includes: a conical surface 11*a* arranged on the lower side thereof a cylindrical surface 11*b* continuous with an upper end of the conical surface 11*a*; and an upper surface 11*c* (which corresponds to a bottom surface of a cone, and is perpendicular to a center axis CA of the conical surface 11*a*) continuous therewith. The cylindrical surface 11*b* and a periphery of the upper surface 11*c* at a vicinity thereof are referred to as an edge portion (11*b*, 11*c*). A recess CP1 is formed in a center portion of the reflector 11 on the upper surface 11*c* side, and the upper surface 11*c* is formed as an annular flat surface. However, the upper surface 11*c* may be formed as a circular flat surface. Further, at an apex position of the reflector 11, a protrusion 11*d* serving as a matching device is provided.

In an upper portion of the reflector 11, that is, in the upper surface 11*c*, there is formed a pair of screw holes 15 into which the pair of screws 14 for fixing the pair of fasteners 13 is screwed.

The number of the screw holes 15 may be one, but it is desired to form two or more screw holes. That is, structure capable of fixing two or more fasteners 13 is desired. Further, it is desired to apply a screw locking agent or the like to the screws 14 in order to prevent the screws 14 from falling off. Note that, it is also effective to employ a method of fixing the fasteners 13 onto the reflector 11, instead of using the screws 14, using press-fitting, a rivet, or spot welding.

The reflector 11 is provided for reflecting radio waves, and hence can he made of a conductor such as a metal. For example, it is preferred that the reflector 11 be made of an aluminum material. However, it is only necessary that the conical surface 11*a* on the lower side of the reflector 11 serves as a reflecting surface (reflect radio waves). Accordingly, the reflector 11 may be formed in such a manner that metal plating is applied to a surface of a reflector main body made of a dielectric, a conductive coating is applied thereto, or a metal seal is pasted thereto.

Figure 16:
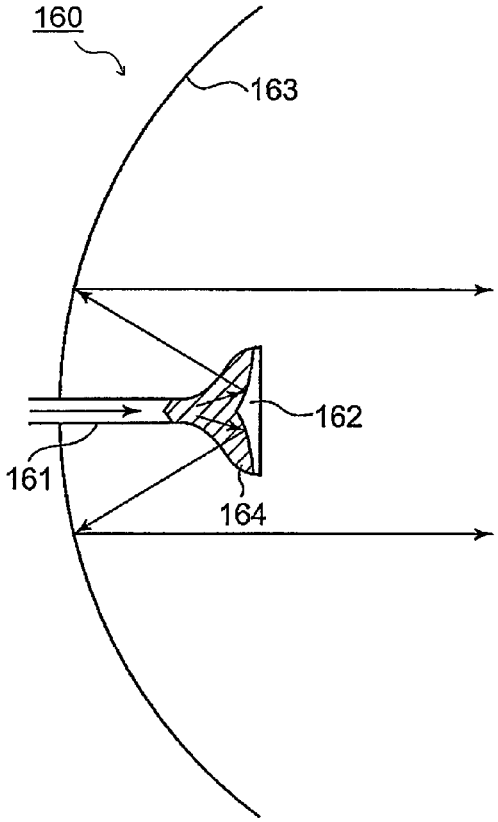
FIG. 16 is a schematic view illustrating a configuration of a conventional antenna.

As illustrated in FIG. 2A, electromagnetic waves from a waveguide (primary radiator) 17 reflect off the reflecting surface 11*a* of the reflector 11 to enter a main reflecting mirror 163 (see FIG. 16).

The dielectric support portion 12 has an inner diameter slightly larger than an outer diameter of the reflector 11. The dielectric support portion 12 includes a conical depression (accommodating portion) CP2 formed in an upper portion thereof, for accommodating the reflector 11, and further includes a tubular outer peripheral wall (tubular portion) 121 formed therearound. An inner diameter of the outer peripheral wall 121 is substantially equal to or slightly larger than the outer diameter of the reflector 11. On an inner peripheral surface 121*a* side of the outer peripheral wall 121, a recessed groove 16 for accommodating a part of each fastener 13 therein is formed along an entire circumference of the outer peripheral wall 121. However, the groove 16 may be formed only in a position corresponding to the fastener 13. Further, a position of the groove 16 in an up-and-down direction is set so as to expose the groove 16 to the outside when the reflector 11 is accommodated in the depression CP2 of the dielectric support portion 12. That is, the groove 16 is formed so as to substantially level a position of a side surface (lower side surface) of the groove 16 with a position of the upper surface 11*c* of the reflector 11. In other words, the groove 16 is formed so as to extend along the edge portion of the reflector 11 accommodated in the depression CP2 of the dielectric support portion 12. A lower portion side of the dielectric support portion 12 is formed into such a shape (protruded shape) as to be inserted and fixed into the waveguide 17 serving as the primary radiator.

As illustrated in FIGS. 1, 2A, and 2B, each fastener 13 has a disk shape, and a screw hole 18 is formed in substantially a center of the fastener. The fastener 13 may be made of a conductor or a dielectric (insulator). Also each screw 14 may be made of a conductor or a dieleetric (insulator).

Next, the reason why the fastener 13 is formed into a disk shape (circular shape) is described. Inasmuch as the fastener 13 has a circular shape, it can he fixed without paying attention to an orientation thereof, which provides satisfactory workability. Further, inasmuch as the fastener 13 has a circular shape, even when the screw 14 is loosened after fixing of the screw 14, and thus the fastener 13 rotates, the fastener 13 is not disengaged from the groove 16. Further, there is an advantage that the same part can he used even when an outer peripheral diameter of the reflector 11 is changed. Still further, the circular fastener 13 has a smaller size and a simpler shape than those of another structure, and hence has an advantage that the fastener is easily processed and easily obtained.

Further, in a case where the fastener 13 is made of a metal, various materials such as stainless steel, copper, brass, phosphor bronze, and aluminum can be used as a material of the fastener. Among the above-mentioned materials, aluminum that is lightweight and high in processability is most suitable. Further, the fastener 13 may he made of a nonmetal, and a plastic plate that is lightweight and excellent in mass productivity may be used. However, the fastener 13 is provided mainly in order to prevent the reflector 11 from falling off, and hence high strength is not required for the fastener 13.

The pair of fasteners 13 and the pair of screws 14 are situated on a back side of the reflecting surface 11*a* of the reflector 11, and hence, as described above, the fasteners 13 and the screws 14 may be made of a conductor (metal).

Figure 3:
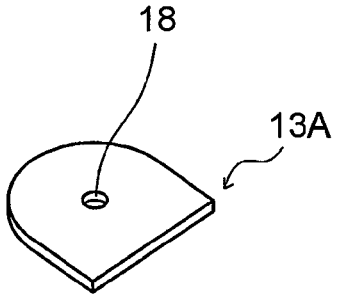
FIG. 3 is a perspective view illustrating another example of a fastener that is usable in the antenna according to the first exemplary embodiment of this invention.

In this exemplary embodiment, the fastener 13 is formed into a circular shape, but may be formed into an arbitrary shape. For example, as illustrated in FIG. 3, a horseshoe-shaped fastener 13A may be adopted. Alternatively, a semi-circular fastener may be adopted. Further, it is necessary that the fastener 13 have a thickness slightly smaller than a width of the groove 16 formed in the inner peripheral surface 121*a* of the outer peripheral wall 121 of the dielectric support portion 12, and have a radius satisfactorily larger than a depth of the groove 16. That is, the fastener 13 has such a size that the fastener is not entirely accommodated in the groove 16 formed in the inner peripheral surface 121*a* of the outer peripheral wall 121 of the dielectric support portion 12, and partially protrudes from the groove 16.

Next, assembly of the feed section 10 will be described.

First, an adhesive is applied entirely or partially to one of or both of opposing surfaces of the reflector 11 and the dielectric support portion 12. The reflector 11 is fitted into the depression CP2 of the dielectric support portion 12 from above. Next, end portions of the pair of fasteners 13 are inserted into the groove 16 formed in the inner peripheral surface 121*a* of the outer peripheral wall 121 of the dielectric support portion 12, and then the pair of fasteners 13 is fixed onto the upper surface 11*c* of the reflector 11 with the pair of screws 14.

In this configuration, the pair of fasteners 13 and the pair of screws 14 serve as an engaging arrangement for engaging the edge portion of the reflector 11 with the outer peripheral wall 121 of the dielectric support portion 12 having the groove 16 formed therein. Further, the pair of fasteners 13, the pair of screws 14, and the outer peripheral wall 121 of the dielectric support portion 12 having the groove 16 formed therein serve as a fall-off preventing arrangement for preventing the reflector 11 from falling off.

With the above-mentioned structure, even when the adhesive that bonds the reflector 11 to the dielectric support portion 12 peels off, the end portions of the pair of fasteners 13, which are fixed onto the reflector 11 with the pair of screws 14, are caught in the groove 16 formed in the inner peripheral surface 121*a* of the outer peripheral wall 121 of the dielectric support portion 12. Accordingly, the reflector 11 is prevented from falling off. Thus, it is possible to prevent interruption of communication caused by falling-off of the reflector 11. In addition, the above-mentioned structure is simply structured, and hence is inexpensive.

Now, the description will proceed to an antenna according to a second exemplary embodiment of this invention.

Figure 4:
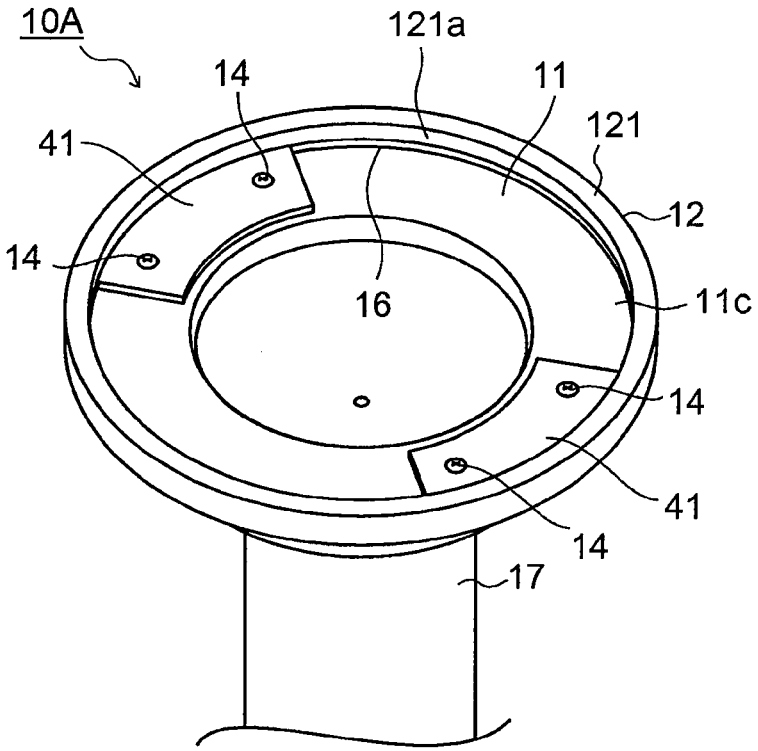
FIG. 4 is a perspective view of a feed section for use in an antenna according to a second exemplary embodiment of this invention.

FIG. 4 is a perspective view illustrating a configuration of a feed section 10A of the antenna according to the second exemplary embodiment. The same components as those of the first exemplary embodiment are denoted by the same reference symbols, and description thereof will be omitted.

Each of a pair of fasteners 41 is formed into a fan shape, and is fixed onto the reflector 11 with two screws 14. The pair of fasteners 41 have outer-peripheral end portions which are fixed so as to be inserted into the groove 16 formed in the inner peripheral surface 121*a* of the outer peripheral wall 121 of the dielectric support portion 12.

Figure 5A:
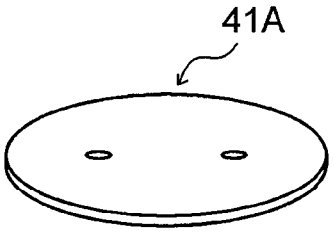
FIGS. 5A and 5B are perspective views each illustrating still another example of a fastener that is usable in the antenna according to the second exemplary embodiment of this invention.
Figure 5B:
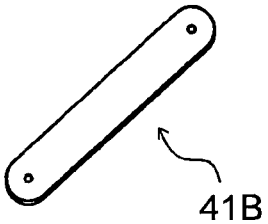

Although FIG. 4 illustrates the fasteners 41 each having a fan shape, as illustrated in FIG. 5A, an elliptical fastener 41A may be adopted. Alternatively, as illustrated in FIG. 5B, a fastener 41B formed of an elongated plate member having rounded ends may be adopted.

Figure 6A:
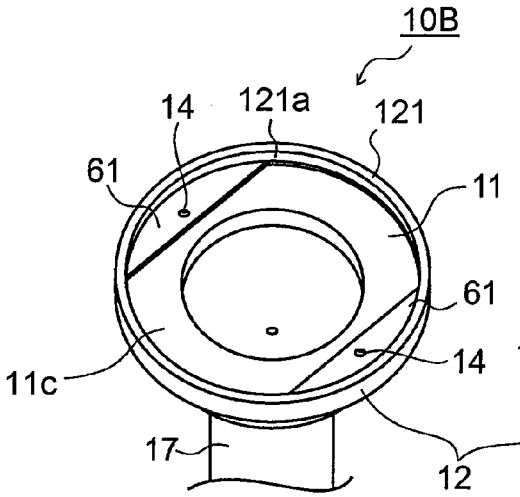
FIGS. 6A and 6B are a perspective view and a partial enlarged view of a feed section for use in an antenna according to a third exemplary embodiment of this invention, respectively.
Figure 6B:
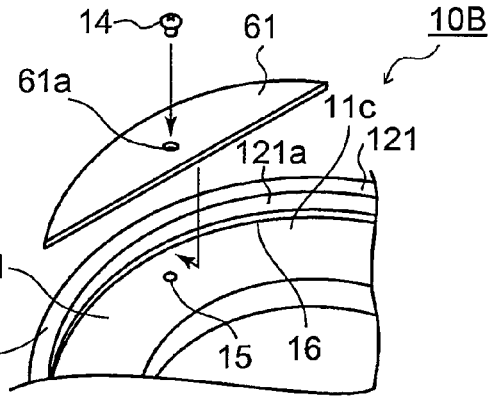

FIGS. 6A and 6B are a perspective view and a partial enlarged view illustrating a configuration of a feed section 10B of an antenna according to a third exemplary embodiment of this invention, respectively.

Each of a pair of fasteners 61 has a partially round shape. Similarly to the first and second exemplary embodiments, under a state in which the pair of fasteners 61 is partially inserted into the groove 16 formed in the inner peripheral surface 121*a* of the outer peripheral wall 121 of the dielectric support portion 12, the pair of fasteners 61 is fixed onto the upper surface 11*c* of the reflector 11 with the pair of screws 14.

FIGS. 6A and 6B illustrate the example of the feed section 10B of the antenna in which a screw hole 61*a* for the screw 14 is formed in each of the pair of fasteners 61. However, as in a case of a feed section 10C of an antenna illustrated in FIGS. 7A and 7B, a pair of fasteners 71 without a screw hole may be used. Alternatively, as in a case of a feed section 10D of an antenna illustrated in FIGS. 8A and 8B, a pair of fasteners 81 each having a partial screw hole (notch) 82 formed therein may be used.

Figure 7A:
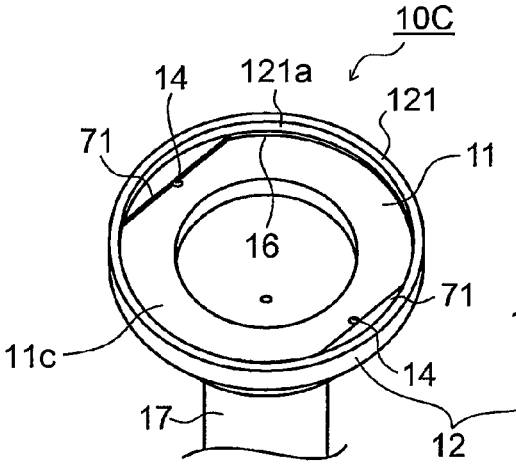
FIGS. 7A and 7B are a perspective view and a partial enlarged view illustrating a modified example of the feed section for use in the antenna according to the third exemplary embodiment of this invention, respectively.
Figure 7B:
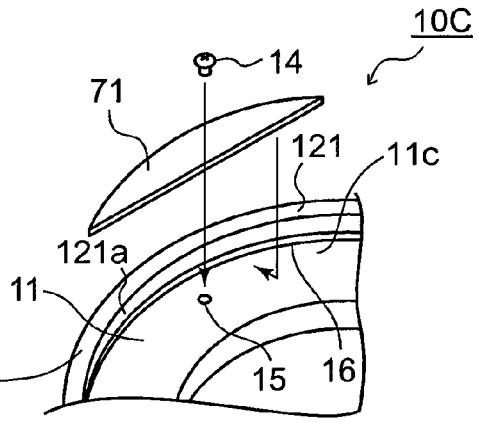

In the example of the feed section 10C of the antenna illustrated in FIGS. 7A and 7B, positions of the pair of screw holes 15, which is formed in the upper surface 11*c* of the reflector 11, are set in order that each of the pair of screws 14 is held in contact with a portion corresponding to a chord of the partially round shape of each of the pair of fasteners 71. Further, a shape and a size of each of the pair of fasteners 71 are designed in order to prevent the pair of fasteners 71 from rotating (being displaced) and falling off. Alternatively, each of the pair of fasteners 71 may be fixed onto the upper surface 11*c* of the reflector 11 with two or more screws 14. This example has an advantage that forming of a screw hole in the fasteners 71 can be omitted.

Figure 8A:
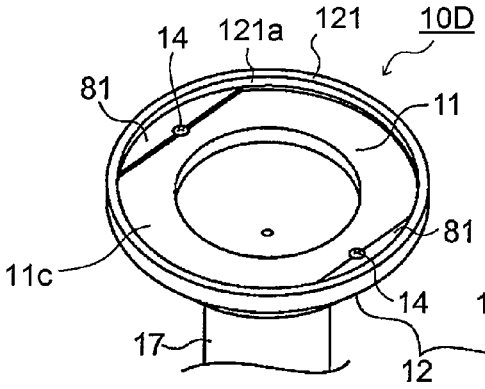
FIGS. 8A and 8B are a perspective view and a partial enlarged view illustrating another modified example of the feed section for use in the antenna according to the third exemplary embodiment of this invention, respectively.
Figure 8B:
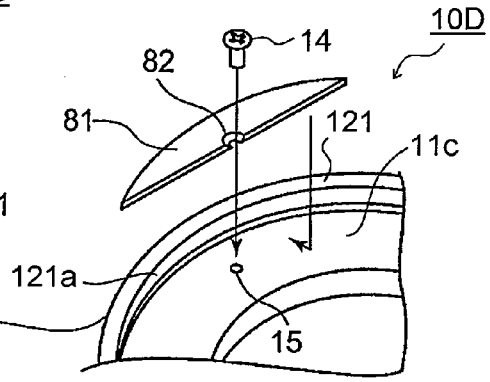

Further, in the example of the feed section 10D of the antenna illustrated in FIGS. 8A and 8B, V-shaped or U-shaped notch can be employed as a partial screw hole 82 which is formed in each of the pair of fasteners 81, and hence forming of a screw hole can be simplified. Further, owing to the presence of the partial screw hole 82 formed in each of the fasteners 81, unlike the example illustrated in FIGS. 7A and 7B, a problem of displacement of the pair of fasteners 71 does not arise. Accordingly, when compared to the example illustrated in FIGS. 7A and 7B, the example illustrated in FIGS. 8A and 8B has an advantage of having a higher degree of freedom in terms of a shape of the pair of fasteners 81.

Figure 9A:
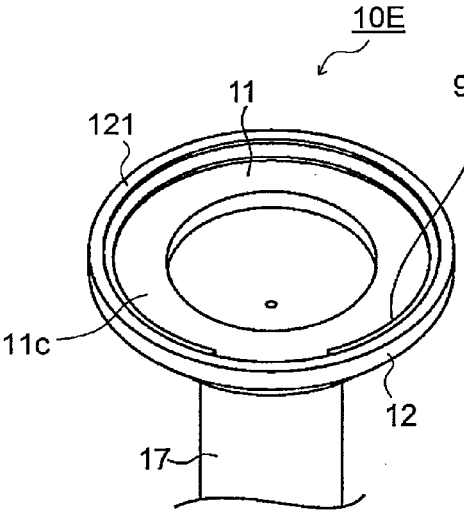
FIGS. 9A and 9B are a perspective view and an exploded perspective view of a feed section for use in an antenna according to a fourth exemplary embodiment of this invention, respectively.
Figure 9B:
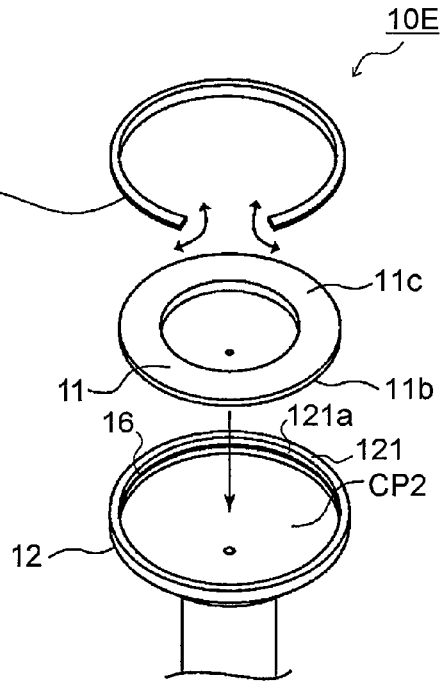

FIGS. 9A and 9B are a perspective view and an exploded perspective view illustrating a configuration of a feed section 10E of an antenna according to a fourth exemplary embodiment of this invention, respectively.

A fastener 91 is formed of an elastic body having a C-shape (C-shaped ring) in which a part of a circular ring is open. The fastener 91 is made of, for example, a metal (spring steel). However, the fastener may be made of another material as long as the other material is an elastic body. It is necessary that the fastener 91 have a height (thickness) slightly smaller than the width of the groove 16 formed in the inner peripheral surface 121*a* of the outer peripheral wall 121 of the dielectric support portion 12, and have a width (difference between an inner diameter and an outer diameter thereof) satisfactorily larger than the depth of the groove 16.

The fastener 91 has an outer diameter slightly larger than an inner diameter of the outer peripheral all 121 of the dielectric support portion 12. The fastener 91 is elastically deformed so as to be reduced in diameter, and is situated inside the outer peripheral wall 121 of the dielectric support portion 12. Then, a part of the fastener is inserted into the groove 16. When deflection of the fastener is released, the fastener 91 is stabilized owing to elasticity thereof in a state in which the part of the fastener 91 is situated in the groove 16. A protruding part of the fastener 91 from the groove 16 prevents the reflector 11 from falling off.

FIGS. 10A to 10F are views each illustrating a modified example of the fastener 91.

Figure 10A:
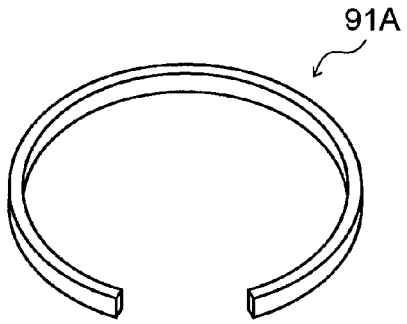
FIGS. 10A to 10F are perspective views each illustrating an example of a fastener that is usable in the antenna according to the fourth exemplary embodiment of this invention.
Figure 10B:
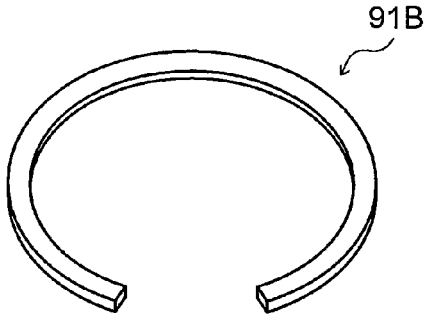

FIG. 10A illustrates an example of a fastener 91A having a vertically-long rectangular cross-section, and FIG. 10B illustrates an example of a fastener 91B having a horizontally-long rectangular cross-section. Each of the fasteners 91A, 91B is formed so that, under a state in which a part (outer peripheral side) of the fastener is inserted into the groove 16 formed in the inner peripheral surface 121*a* of the outer peripheral wall 121 of the dielectric support portion 12, another part (inner peripheral side) thereof protrudes from the groove 16. Note that, the fastener is easily handled when corner portions thereof are rounded.

FIGS. 10C to 10F illustrate examples of fasteners 91C, 91D, 91E, and 91F each having a circular or elliptical cross-section, respectively. Each fastener may have an arbitrary sectional shape, but the fastener is easily handled when the fastener has a circular or elliptical cross-section.

Figure 10C:
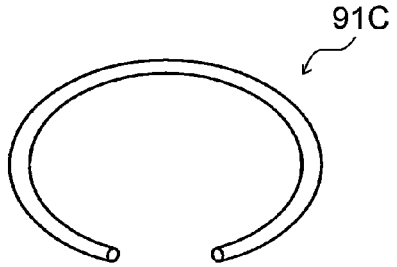

FIG. 10C illustrates the example of the C-shaped fastener 91C. Similarly to the examples illustrated in FIGS. 10A and 10B, the fastener 91C is formed so that, under a state in which a part (outer peripheral side) of the fastener is inserted into the groove 16 formed in the inner peripheral surface 121*a* of the outer peripheral wall 121 of the dielectric support portion 12, another part (inner peripheral side) thereof protrudes from the groove 16.

Figure 10D:
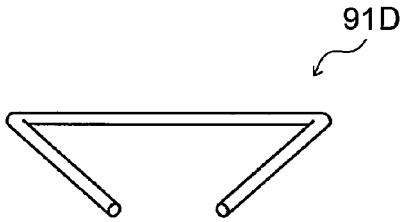
Figure 10E:
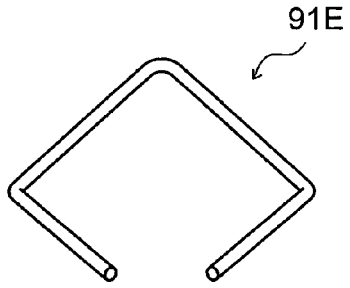
Figure 10F:
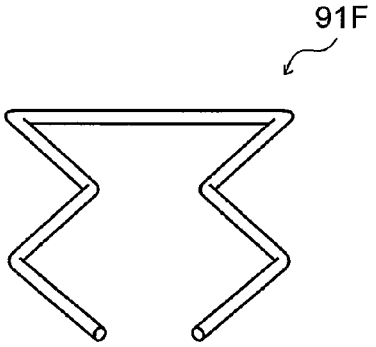

FIGS. 10D, 10E, and 10F illustrate the examples of the fasteners 91D), 91E , and 91F which are bent into a triangular, quadrangular , and polygonal shape, respectively. Unlike the examples of the fasteners 91A, 91B, and 91C illustrated in FIGS. 10A to 10C, the fasteners 91D), 91E , and 91F do not have a limitation that requires a larger difference between an inner diameter and an outer diameter of each fastener than the depth of the groove 16 formed in the inner peripheral surface 121*a* of the outer peripheral wall 121 of the dielectric support portion 12, and hence have a high degree of design freedom. In each of the fasteners 91D, 91E, and 91F, elbow portions (or elbow portions and end portions) are inserted into the groove 16 formed in the inner peripheral surface 121*a* of the outer peripheral wall 121 of the dielectric support portion 12, and another part protrudes from the groove 16. Thus, the fastener prevents the reflector 11 from falling off.

Figures 11A, 11B:
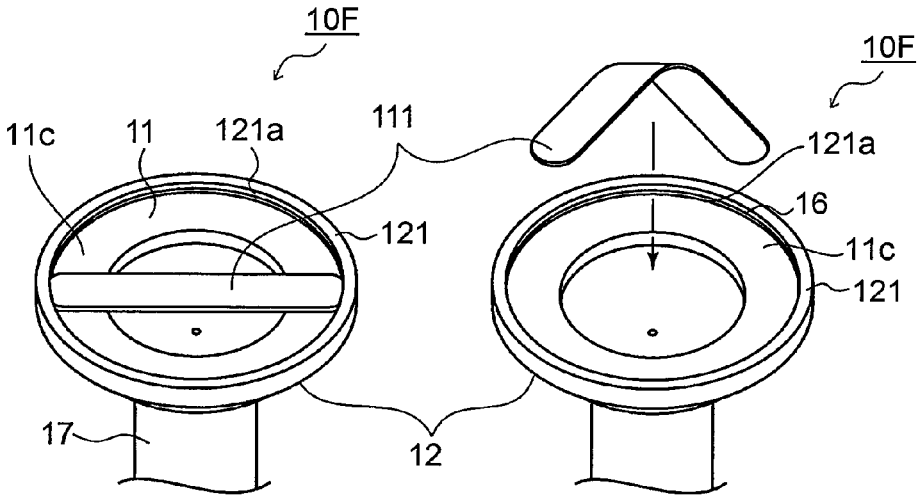
FIGS. 11A and 11B are a perspective view and an exploded perspective view of a feed section for use in an antenna according to a fifth exemplary embodiment of this invention, respectively.

FIGS. 11A and 11B are a perspective view and an exploded perspective view illustrating a configuration of a feed section 10F of an antenna according to a fifth exemplary embodiment of this invention, respectively.

The fastener 111 is formed of a thin and elongated elastic plate having rounded ends. The fastener 111 has a length larger than the inner diameter of the outer peripheral all 121 of the dielectric support portion 12. Further, no screw hole is formed in the fastener 111.

As illustrated in FIG. 11B, the fastener 111 is elastically deformed, and thus both ends of the fastener can be inserted into the groove 16 formed in the inner peripheral surface 121*a* of the outer peripheral wall 121 of the dielectric support portion 12.

Figures 12A, 12B:
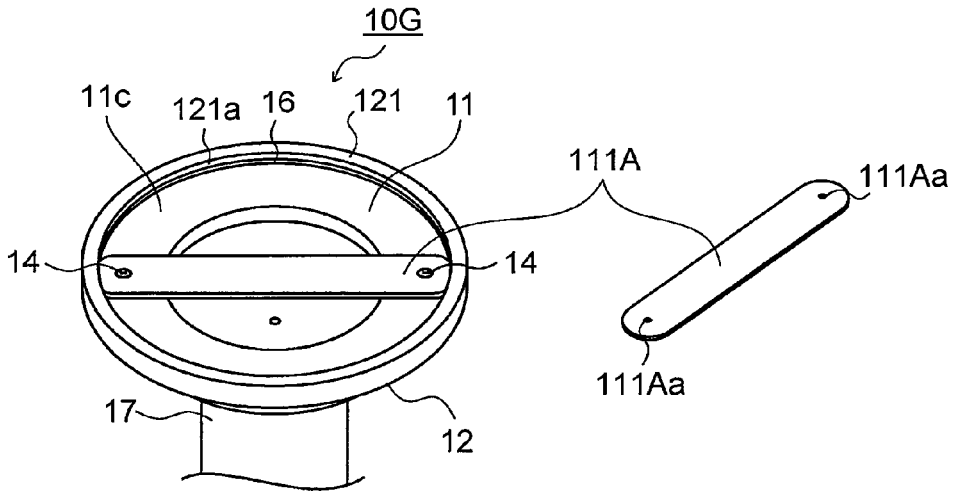
FIGS. 12A and 12B are a perspective view illustrating a modified example of the feed section for use in the antenna according to the fifth exemplary embodiment of this invention and a perspective view of a fastener thereof, respectively.

The fastener 111 may be fixed onto at least one of the reflector 11 and the dielectric support portion 12 with an adhesive. Alternatively, as in a case of a feed section 10G of an antenna illustrated in FIGS. 12A and 12B, a fastener 111A, which has a pair of screw holes 111Aa formed therein, may be fixed onto the upper surface 11*c* of the reflector 11 with the pair of screws 14. With use of the pair of screws 14, the fastener 111A is fixed onto the reflector 11 more firmly, and hence it is possible to reliably prevent the reflector from filling off.

Figure 13:
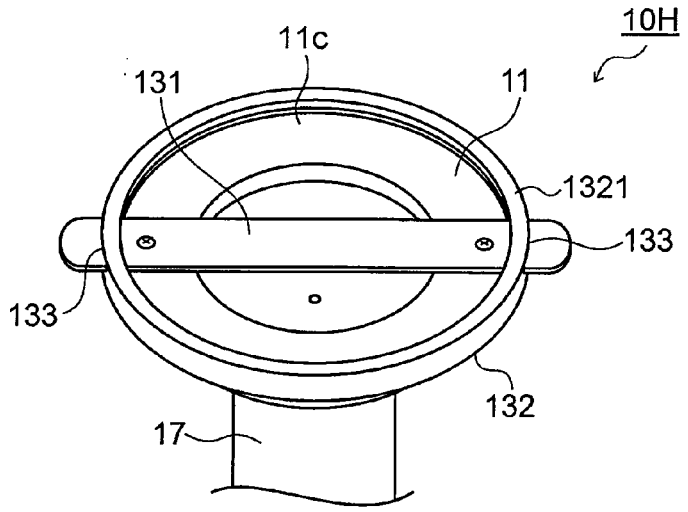
FIG. 13 is a perspective view of a feed section for use in an antenna according to a sixth exemplary embodiment of this invention.
Figure 14A:
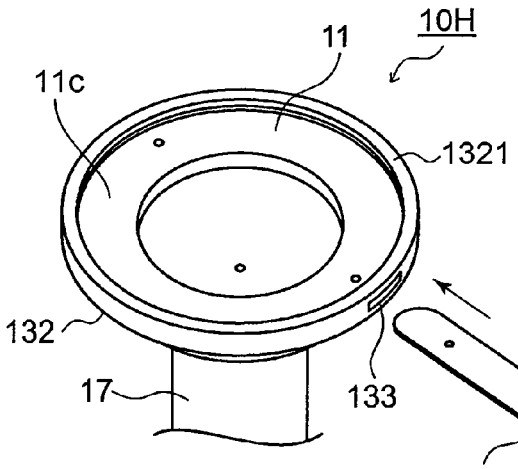
FIGS. 14A and 14B are process diagrams each illustrating a step of assembling the feed section illustrated in FIG. 1.
Figure 14B:
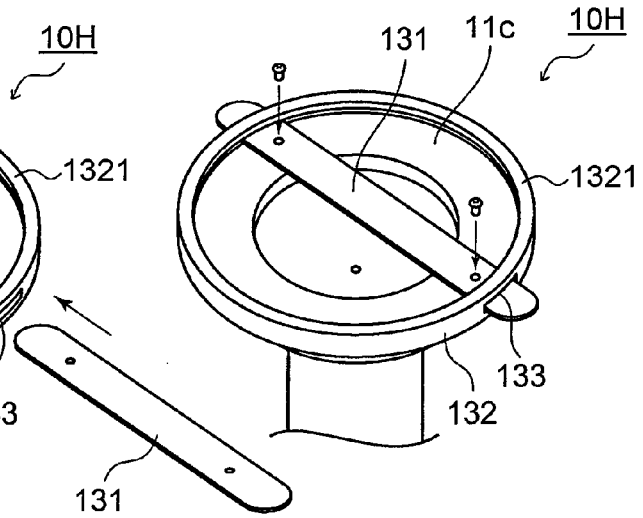

FIG. 13 is a perspective view illustrating a configuration of a feed section 10H of an antenna according to a sixth exemplary embodiment of this invention, and FIGS. 14A and 14B are process diagrams each illustrating a step of assembling the feed section 10H.

The feed section 10H according to this embodiment includes a fastener 131 and a dielectric support portion 132.

The fastener 131 has a length larger than an outer diameter of the dielectric support portion 132. Unlike the fastener 111 or the fastener 111A for use in the fifth exemplary embodiment, the fastener 131 does not need to be elastic.

In the dielectric support portion 132, the groove 16 formed in the dielectric support portion 12 is not formed. However, as is understood from FIG. 14A, a pair of through-holes 133, into which the fastener 131 is inserted, is formed in an outer peripheral wall 132*l* of the dielectric support portion 132. Forming positions of the through-holes 133 are similar to the position of the groove 16, that is, the forming positions of the through-holes 133 are determined so as to enable the fastener 131 to be inserted into the through-holes 133 under a state in which the reflector 11 is accommodated in a depression of the dielectric support portion 132. For example, the forming positions of the through-holes 133 are determined so as to level a lower edge of each of the through-holes 133 with the upper surface 11*c* of the reflector 11.

The feed section is assembled in the following manner.

First, as illustrated in FIG. 14A, under a state in which the reflector 11 is accommodated in the depression of the dielectric support portion 132, the fastener 131 is inserted into both the pair of through-holes 133. Then, as illustrated in FIG. 14B, the fastener 131 is fixed onto the upper surface 11*c* of the reflector 11 with the pair of screws 14.

In the above-mentioned manner, according to this embodiment, with use of one fastener 131, the reflector can he reliably prevented from falling off without elastically deforming the fastener.

Figures 15A, 15B:
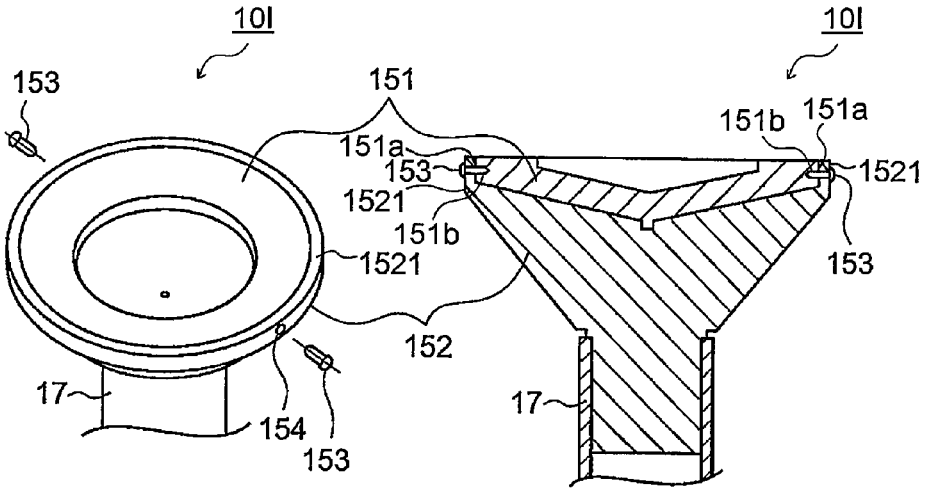
FIGS. 15A and 15B are an exploded perspective view and a longitudinal sectional view of a feed section for use in an antenna according to a seventh exemplary embodiment of this invention, respectively.

FIGS. 15A and 15B are an exploded perspective view and a longitudinal sectional view illustrating a configuration of a feed section 101 of an antenna according to a seventh exemplary embodiment of this invention, respectively.

The illustrated feed section 101 includes a reflector 151, a dielectric support portion 152, and a pair of screws 153.

A pair of screw holes 151*b*, into which the pair of screws 153 is screwed, is formed in an upper outer peripheral surface 151*a* of the reflector 151. Further, a pair of through-holes 154, into which the pair of screws 153 is inserted, is formed in an outer peripheral wall 152*l* of the dielectric support portion 152.

The reflector 151 is fixed onto the dielectric support portion 152 with the pair of screws 153 under a state in which the reflector 151 is accommodated in a depression of the dielectric support portion 152. That is, the pair of screws 153 is inserted into the pair of through-holes 154 from an outer peripheral side of the outer peripheral wall 152*l* of the dielectric support portion 152, and is screwed into the pair of screw holes 151*b* formed in the reflector 151. Instead of using the pair of screws 152, a pair of engaging pieces may be press-fitted into the pair of through-holes 154. Alternatively, the pair of screw holes 151*b* is not formed in the reflector 151, but a pair of screw holes is formed in the dielectric support portion 152. With this configuration, tips of the pair of screws 153 may press and support the reflector 151.

While this invention has been particularly shown and described with reference to exemplary embodiments thereof, this invention is not limited to the above-mentioned exemplary embodiments. It will be understood by those of ordinary skill in the art that various modifications and changes in form and details may be made therein without departing from the spirit and scope of the present invention as defined by the claims.

For example, regarding each fastener for use in the first to third and fifth exemplary embodiments, it is only necessary that a part of the fastener be situated in the groove and another part thereof be held in contact with (can be fixed onto) the reflector, and the fastener may have a three-dimensional shape such as a curved shape instead of a flat plate-like shape. Also regarding the sixth exemplary embodiment, the fastener can be formed into a three-dimensional shape as long as one end portion of the fastener is inserted into one through-hole by a predetermined amount or more from an inner side of the outer peripheral wall, and thus another end portion thereof can be inserted into another through-hole.

Further, the fastener may be fixed by screw fixation or bonding, and another method may be adopted.

The whole or part of the exemplary embodiments described above can be described as, but not limited to, the following supplementary notes.

(Supplementary note 1) An antenna, including:

a dielectric support portion mounted to a tip of a waveguide; and a reflector bonded and fixed to the dielectric support portion, wherein the dielectric support portion includes:

an accommodating portion accommodating the reflector therein; and a fall-off preventing arrangement preventing the reflector from falling off under a state in which the reflector is accommodated in the accommodating portion.

(Supplementary note 2) An antenna according to Supplementary note 1, wherein the fall-off preventing arrangement includes a tubular portion provided around the accommodating portion, and an engaging arrangement engaging an edge portion of the reflector with the tubular portion.

(Supplementary note 3) An antenna according to Supplementary note 2, wherein the engaging arrangement includes a groove which is formed in an inner peripheral surface of the tubular portion along the edge portion of the reflector, and a plate member which is partially inserted into the groove.

(Supplementary note 4) An antenna according to Supplementary note 3, wherein the plate member has a shape selected from the group consisting of a circular shape, an elliptical shape, a semicircular shape, a horseshoe-shape, a fan shape, and a C-shape.

(Supplementary note 5) An antenna according to Supplementary note 2, wherein the engaging arrangement includes a through-hole which is formed in the tubular portion, and a plate member which is inserted into the through-hole.

(Supplementary note 6) An antenna according to any one of Supplementary notes 3, 4 and 5, wherein the engaging arrangement further includes a screw for fixing the plate member to the reflector.

(Supplementary note 7) An antenna according to any one of Supplementary notes 3, 4 and 5, wherein the engaging arrangement further includes an adhesive material for fixing the plate member to the reflector.

(Supplementary note 8) An antenna according to Supplementary note 2, Wherein the engaging arrangement includes a groove which is formed in an inner peripheral surface of the tubular portion along the edge portion of the reflector, and a bending spring member which is partially inserted into the groove.

(Supplementary note 9) An antenna according to Supplementary note 2, wherein the engaging arrangement includes a through-hole which is formed in the tubular portion, and a fixing screw which is inserted into the through-hole and is screwed into a screw hole formed in the edge portion of the reflector.

(Supplementary note 10) An antenna according to any one of Supplementary notes 1 to 9, wherein the reflector has substantially a conical shape, and includes a reflecting surface having a conical surface shape, a cylindrical surface continuous with the reflecting surface, and a flat surface which is perpendicular to a center axis of the conical surface shape and continuous with the cylindrical surface.

(Supplementary note 11) An antenna according to Supplementary note 10, wherein the edge portion is the cylindrical surface and a periphery of the flat surface continuous with the cylindrical surface.

(Supplementary note 12) An antenna according to any one of Notes 1 to 11, wherein the antenna is a dual reflector antenna in which the reflector is used as a sub-reflector.

REFERENCE SIGNS LIST

10 to 10I feed section of antenna
11 reflector
11*a* conical surface (reflecting surface)
11*b* cylindrical surface
11*c* upper surface
11*d* protrusion
12 dielectric support portion
121 outer peripheral wall
121*a* inner peripheral surface
13, 13A fastener
14 screw
15 screw hole
16 groove
17 waveguide
18 screw hole
41, 61, 71, 81 fastener
82 partial screw hole
91 to 91F, 111, 111A, 131 fastener
132 dielectric support portion
133 through-hole
151 reflector
152 dielectric support portion
153 screw
154 through-hole
161 primary radiator
162 sub-reflecting mirror
163 main reflecting mirror
164 dielectric support member

The invention claimed is:

1. An antenna, comprising:

a dielectric support portion mounted to a tip of a waveguide; and a reflector bonded and fixed to the dielectric support portion, wherein the reflector has substantially a conical shape, and comprises a reflecting surface having a conical surface shape, a cylindrical surface continuous with the reflecting surface, and a flat surface which is perpendicular to a center axis of the conical surface shape and continuous with the cylindrical surface, wherein the dielectric support portion comprises:

an accommodating portion accommodating the reflector therein; and a fall-off preventing arrangement preventing the reflector from falling off under a state in which the reflector is accommodated in the accommodating portion, wherein the fall-off preventing arrangement comprises a tubular portion provided around the accommodating portion, and an engaging arrangement engaging an edge portion of the reflector with the tubular portion, wherein the edge portion is the cylindrical surface and a periphery of the flat surface continuous with the cylindrical surface, wherein the engaging arrangement comprises a groove which is formed in an inner peripheral surface of the tubular portion along the edge portion of the reflector, and a plate member which is partially inserted into the groove.

2. An antenna according to claim 1, wherein the plate member has a shape selected from the group consisting of a circular shape, an elliptical shape, a semicircular shape, a horseshoe-shape, a fan shape, and a C-shape.

3. An antenna according to claim 1, wherein the engaging arrangement further comprises a screw for fixing the plate member to the reflector.

4. An antenna according to claim 1, wherein the engaging arrangement further comprises an adhesive material for fixing the plate member to the reflector.

5. An antenna, comprising:

a dielectric support portion mounted to a tip of a waveguide; and a reflector bonded and fixed to the dielectric support portion, wherein the reflector has substantially a conical shape, and comprises a reflecting surface having a conical surface shape, a cylindrical surface continuous with the reflecting surface, and a flat surface which is perpendicular to a center axis of the conical surface shape and continuous with the cylindrical surface, wherein the dielectric support portion comprises:

an accommodating portion accommodating the reflector therein; and a fall-off preventing arrangement preventing the reflector from falling off under a state in which the reflector is accommodated in the accommodating portion, wherein the fall-off preventing arrangement comprises a tubular portion provided around the accommodating portion, and an engaging arrangement engaging an edge portion of the reflector with the tubular portion, wherein the edge portion is the cylindrical surface and a periphery of the flat surface continuous with the cylindrical surface, wherein the engaging arrangement comprises a groove which is formed in an inner peripheral surface of the tubular portion along the edge portion of the reflector, and a bending spring member which is partially inserted into the groove.

6. An antenna according to claim 1, wherein the antenna is a dual reflector antenna in which the reflector is used as a sub-reflector.

7. An antenna according to claim 5, wherein the antenna is a dual reflector antenna in which the reflector is used as a sub-reflector.

* * * * *